US010525709B2

(12) United States Patent
Sato et al.

(10) Patent No.: US 10,525,709 B2
(45) Date of Patent: Jan. 7, 2020

(54) NOZZLE PLATE, LIQUID EJECTING HEAD, AND LIQUID EJECTING APPARATUS

(71) Applicant: SEIKO EPSON CORPORATION, Tokyo (JP)

(72) Inventors: Mitsuru Sato, Suwa (JP); Takashi Saiba, Shiojiri (JP); Yasutaka Matsumoto, Suwa (JP); Satoshi Suzuki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/013,058

(22) Filed: Jun. 20, 2018

(65) Prior Publication Data

US 2018/0370231 A1 Dec. 27, 2018

(30) Foreign Application Priority Data

Jun. 22, 2017 (JP) ..... 2017-121990

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/1606* (2013.01); *B41J 2202/03* (2013.01)

(58) Field of Classification Search
CPC ..... B41J 2/1433; B41J 2202/03
See application file for complete search history.

(56) References Cited

U.S. PATENT DOCUMENTS 6,284,377 B1 * 9/2001 Veerasamy ..... B05D 5/083 428/408
6,511,156 B1 * 1/2003 Kazama ..... B41J 2/1433 347/47
7,097,286 B2 * 8/2006 Higa ..... B41J 2/14145 347/71
7,918,534 B2 * 4/2011 Inoue ..... B41J 2/1433 347/45
8,303,083 B2 * 11/2012 Fujii ..... B41J 2/1606 347/22
8,384,748 B2 * 2/2013 Law ..... B41J 13/076 205/68
8,506,051 B2 * 8/2013 Gulvin ..... B41J 2/1606 347/47
9,205,653 B2 * 12/2015 Tamai ..... B41J 2/1606
2005/0001879 A1 1/2005 Miyajima et al.
2012/0098896 A1 * 4/2012 Nihei ..... B41J 2/14233 347/68
2014/0183284 A1 7/2014 Nagatoya et al.

FOREIGN PATENT DOCUMENTS

CN 1550337 12/2004
JP 2012-091380 A 5/2012
JP 2014-124874 A 7/2014

* cited by examiner

*Primary Examiner* — Bradley W Thies
(74) *Attorney, Agent, or Firm* — Workman Nydegger

(57) ABSTRACT

A nozzle plate includes a nozzle open to one surface of the nozzle plate to eject ink, and a diamond-like carbon (DLC) layer disposed adjacent to the one surface. The DLC layer has surface irregularities including recesses and protrusions. The protrusions adjoining one another have ends to be in contact with the ink. The ends are located at mutually different positions in a direction intersecting the one surface.

10 Claims, 4 Drawing Sheets

NOZZLE PLATE, LIQUID EJECTING HEAD, AND LIQUID EJECTING APPARATUS

BACKGROUND

1. Technical Field

The present invention relates to a nozzle plate having a liquid repellent surface, a liquid ejecting head, and a liquid ejecting apparatus.

2. Related Art

Liquid ejecting apparatuses are equipped with a liquid ejecting head including a nozzle plate having nozzles, which eject various types of liquid. A typical example of such liquid ejecting apparatuses is an image recording apparatus, such as an ink jet printer or ink jet plotter. The configuration of the liquid ejecting apparatus enables extremely small droplets of liquid to be accurately landed at predetermined positions and has thus recently been applied to various manufacturing apparatuses. Examples of such manufacturing apparatuses include display manufacturing apparatuses that fabricate color filters of, for example, liquid crystal displays, electrode forming apparatuses that form electrodes of, for example, organic electroluminescence (EL) displays and field emission displays (FEDs), and chip manufacturing apparatuses that fabricate biochips. A recording head for the image recording apparatus ejects liquid ink, and a color-filter-material ejecting head for the display manufacturing apparatus ejects solutions of the respective color filter materials of red (R), green (G), and blue (B). An electrode material ejecting head for the electrode forming apparatus ejects an electrode material in a liquid state, and a bioorganic-material ejecting head for the chip manufacturing apparatus ejects a solution of a bioorganic material.

In such liquid ejecting apparatuses, some liquid droplets ejected from the nozzles may adhere to the surface (specifically, the surface from which the droplets are ejected) of the nozzle plate. In particular, the liquid adhering to the vicinities of the nozzles may cause problems, such as varying the trajectories of the droplets ejected from the nozzles due to the interference between the adhering liquid and the droplets. In order to reduce such problems, a liquid ejecting head that includes a nozzle plate having a liquid repellent film on the surface thereof has been disclosed (refer to JP-A-2014-124874).

Some of the liquid ejecting apparatuses are equipped with a wiping member (for example, a wiper) for wiping the surface of the nozzle plate to remove, for example, the ink and contaminants adhering to the surface of the nozzle plate. The wiping operation of the wiping member, however, may abrade the liquid repellent film on the nozzle plate surface, resulting in a reduction in the liquid repellency property of the nozzle plate surface. In particular, in the case where the liquid ejected from the nozzles contains a pigment, such as titanium oxide, this pigment functions as an abrasive material and more readily abrades the liquid repellent film.

SUMMARY

An advantage of some aspects of the invention is to provide a nozzle plate, reduction in liquid repellency property of which is suppressed, a liquid ejecting head, and a liquid ejecting apparatus.

A nozzle plate according to a first aspect of the invention, which has been proposed to realize the above advantage, includes a nozzle open to one surface of the nozzle plate to eject liquid, and a diamond-like carbon layer disposed adjacent to the one surface. The diamond-like carbon layer has surface irregularities including recesses and protrusions. The protrusions adjoining one another have ends to be in contact with the liquid. The ends are located at mutually different positions in a direction intersecting the one surface.

The surface irregularities of the diamond-like carbon layer can provide liquid repellency property to the one surface of the nozzle plate. In other words, the lotus effect can improve the liquid repellency property of the one surface of the nozzle plate. In addition, the diamond-like carbon layer (liquid repellent layer) that provides liquid repellency property to the nozzle plate has high abrasion resistance (in other words, durability) and can thus suppress a reduction in the liquid repellency property of the one surface of the nozzle plate.

In the above-mentioned configuration, it is preferable that the surface irregularities of the diamond-like carbon layer be defined by particles having various sizes, the particles being arranged adjacent to one another.

This configuration can facilitate formation of the surface irregularities of the diamond-like carbon layer.

In any of the above-mentioned configurations, it is preferable that the diamond-like carbon layer contain fluorine.

This configuration can further improve the liquid repellency property of the one surface of the nozzle plate.

In any of the above-mentioned configurations, it is preferable that the diamond-like carbon layer have an arithmetic average surface roughness Ra equal to or higher than 0.08 μm and equal to or lower than 1 μm.

This configuration can further improve the liquid repellency property of the one surface of the nozzle plate.

It is preferable that the nozzle plate having any of the above-mentioned configurations further include an amorphous layer disposed adjacent to the one surface, and that the diamond-like carbon layer be layered on the amorphous layer.

This configuration can improve the adhesion of the diamond-like carbon layer to the nozzle plate and can thus suppress a reduction in the liquid repellency property caused by peeling of a part of the diamond-like carbon layer.

A liquid ejecting head according to a second aspect of the invention includes the nozzle plate having any of the above-mentioned configurations.

This configuration can improve the reliability of the liquid ejecting head because of the nozzle plate having high durability.

A liquid ejecting apparatus according to a third aspect of the invention includes the liquid ejecting head having the above-mentioned configuration.

This configuration can improve the reliability of the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention are described with reference to the accompanying drawings. Although the preferable embodiments of the invention described below have various limitations, these embodiments should not be construed as limiting the scope of the invention, unless otherwise indicated in the description below. In the following, an exemplary ink jet recording head (hereinafter referred to as "recording head") 3 is descried as a type of liquid ejecting head being installed in an ink jet printer (hereinafter referred to as "printer") 1 which is a type of liquid ejecting apparatus.

Figure 1:
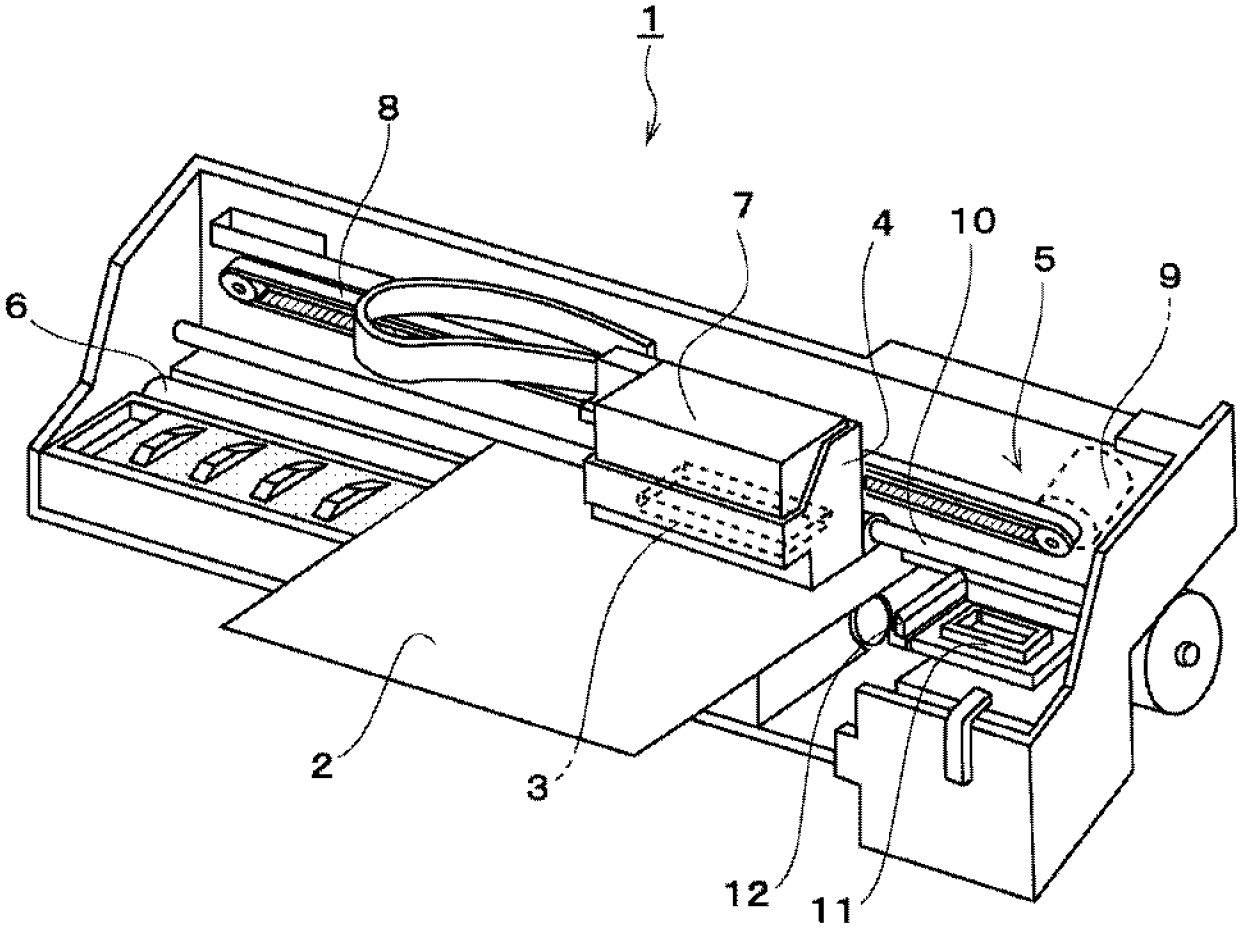
FIG. 1 is a perspective view of the configuration of a printer.

FIG. 1 is a perspective view of a printer 1. The printer 1 ejects ink (a type of liquid) onto the surface of a recording medium 2 (a type of landing target), such as a recording sheet, to record images and other data. The printer 1 includes a recording head 3, a carriage 4 to which the recording head 3 is attached, a carriage moving mechanism 5 that moves the carriage 4 in the main scanning direction, and a transport mechanism 6 that transports the recording medium 2 in the sub-scanning direction. The ink is stored in an ink cartridge 7 that functions as a liquid supply source. The ink cartridge 7 is removably mounted on the recording head 3. Alternatively, the ink cartridge may be disposed in the body of the printer and supply ink to the recording head through an ink supply tube.

The carriage moving mechanism 5 has a timing belt 8. The timing belt 8 is driven by a pulse motor 9, such as a DC motor. When the pulse motor 9 is started, the carriage 4 reciprocates along a guide rod 10 disposed across the printer 1 in the main scanning direction (the width direction of the recording medium 2). The position of the carriage 4 in the main scanning direction is detected by a linear encoder (not shown), which is a type of location information detecting device. The linear encoder transmits the detection signal, that is, encoder pulse (a type of location information) to a controller of the printer 1.

The position outside the print area, through which the recording medium 2 is transported, adjacent to one side of the printer 1 in the main scanning direction (the right side in FIG. 1) is predetermined as a home position, where the recording head 3 is located in a waiting state. A cap 11 and a wiper 12 are provided at the home position. The cap 11 is made of, for example, an elastic material and seals a nozzle surface 23 (described later) of the recording head 3 waiting in the home position. The wiper 12 wipes the nozzle surface 23 of the recording head 3 waiting in the home position. The wiper 12 according to the embodiment is made of an elastic material, such as elastomer, and has a blade shape. Alternatively, the wiper 12 may be composed of a sheet-like material made of cotton, silk, or other fabrics.

Figure 2:
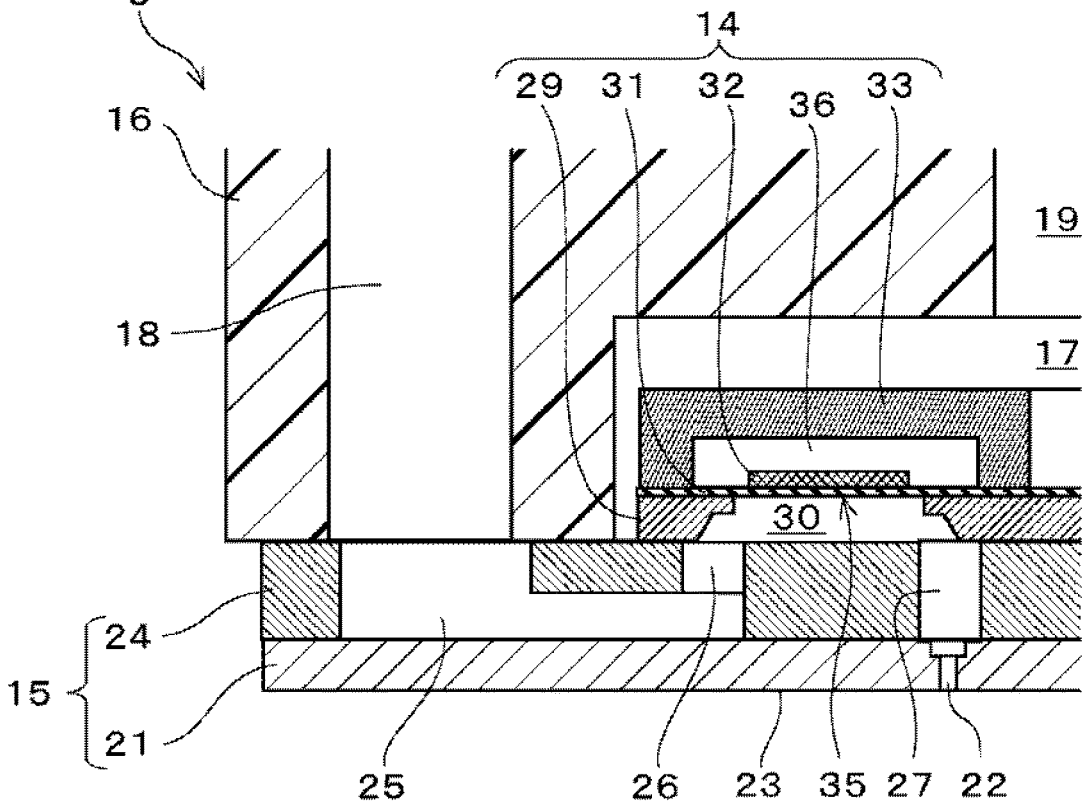
FIG. 2 is a sectional view of a main portion of the configuration of a recording head.
Figure 3:
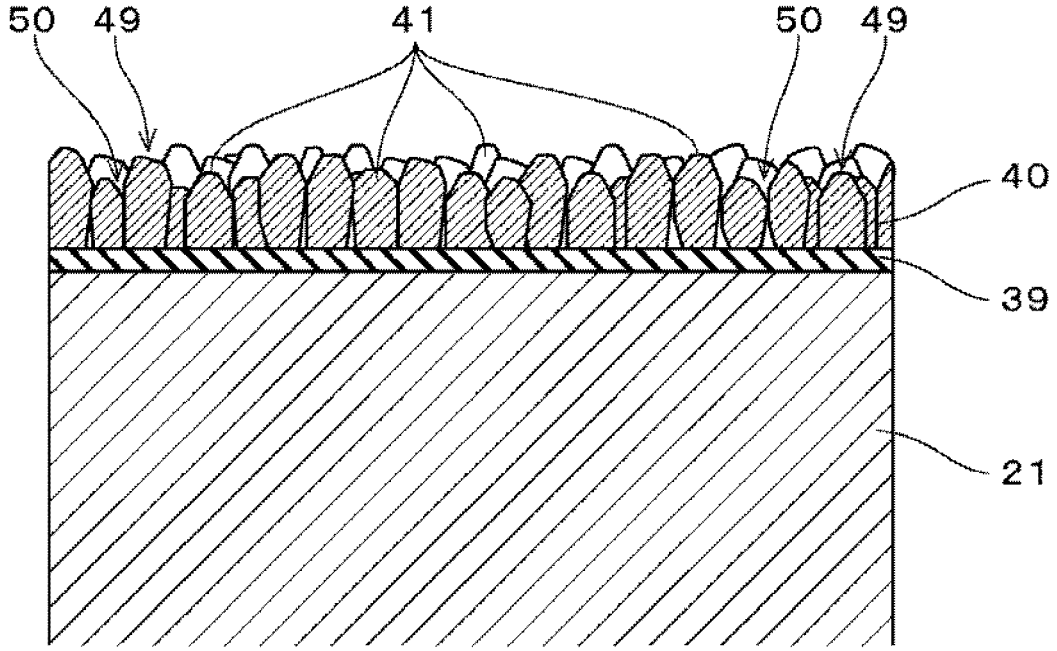
FIG. 3 is an enlarged schematic sectional view of a nozzle plate.

The recording head 3 is described. FIG. 2 is a sectional view describing a main portion of the configuration of the recording head 3. FIG. 3 is an enlarged schematic sectional view of a nozzle plate 21. Note that FIG. 2 illustrates only the left half of the section of the recording head 3 having a substantially bilaterally symmetrical configuration in the direction orthogonal to the nozzle array direction. The nozzle surface 23 faces upward in FIG. 3, whereas the nozzle surface 23 faces downward in FIG. 2. In the following description, the side adjacent to a head case 16 is defined as the upper side, and the side adjacent to the nozzle surface 23 is defined as the lower side for convenience of description. With reference to FIG. 2, a channel unit 15 and an actuator unit 14 mounted on the channel unit 15 are attached to the head case 16 in the recording head 3 according to the embodiment.

The head case 16 is a housing made of a synthetic resin. The head case 16 is provided with an internal liquid supply path 18 for ink supply to pressure chambers 30. The liquid supply path 18 and a common liquid chamber 25 (described later) define spaces for storing ink to be shared by the pressure chambers 30. In the embodiment, two liquid supply paths 18 corresponding to two rows of the pressure chambers 30 are provided. The lower part of the head case 16 (adjacent to the channel unit 15) has a hollow portion extending from the lower surface of the head case 16 (the surface adjacent to the channel unit 15) to the middle of the head case 16 in the height direction. This hollow portion defines an accommodating space 17 having a rectangular parallelepiped shape. When the channel unit 15 is joined to the lower surface of the head case 16 at an appropriate position, the actuator unit 14 mounted on a communication substrate 24 (described later) is accommodated in the accommodating space 17. A part of the top surface defining the accommodating space 17 has an insertion opening 19 that enables the accommodating space 17 to communicate with the outside of the head case 16. A circuit board (not shown) such as a flexible printed circuit (FPC) board is inserted into the accommodating space 17 through the insertion opening 19 and connected to the actuator unit 14 in the accommodating space 17.

The channel unit 15 according to the embodiment includes the communication substrate 24 and the nozzle plate 21. The nozzle plate 21 is a silicon substrate (for example, silicon single crystal substrate) joined to the lower surface of the communication substrate 24 (the surface opposite to a pressure chamber defining substrate 29). In the embodiment, the nozzle plate 21 defines the bottom of space that functions as the common liquid chamber 25 (described later). The nozzle plate 21 is provided with nozzles 22 arranged in straight lines (rows). Two rows of the nozzles 22 (that is, two nozzle arrays) are provided in the nozzle plate 21. The nozzles 22 included in each nozzle array, from the nozzle 22 at one end to the nozzle 22 at the other end, are arranged at regular intervals corresponding to the density of ink dots to be formed, for example, in the main scanning direction. The nozzle plate 21 may be joined to a region of the communication substrate inside a region corresponding to the common liquid chamber, while a flexible member (for example, a compliance sheet) may define the bottom of the space that functions as the common liquid chamber. In the following description, the outer surface of the nozzle plate 21 (the surface facing downward in FIG. 2, corresponding to one surface of the invention), to which the nozzles 22 are open, is referred to as "nozzle surface 23".

With reference to FIG. 3, surfaces of the nozzle plate 21 according to the embodiment are provided with an underlying layer 39. The underlying layer 39 includes a thermally oxidized film ($SiO_2$), and a tantalum oxide film ($TaO_x$) or tantalum nitride film (TaN) layered on the thermally oxidized film. The underlying layer 39 has ink resistance and protects the surfaces of the nozzle plate 21. The underlying layer 39 can protect the nozzle surface 23 of the nozzle plate 21 regardless of a defect, such as a pin hole or crack, that has occurred in any part of a diamond-like carbon (DLC) layer 40. The underlying layer 39 may have a monolayer structure including a single layer or a layered structure including multiple layers layered on each other. In the layered structure, the outermost layer alone has to have ink resistance.

The underlying layer 39 is also provided on the inner surfaces of the nozzles 22 and on the surface of the nozzle plate 21 opposite to the nozzle surface 23.

On the surface of the underlying layer 39 on the nozzle surface 23 (corresponding to the one surface of the nozzle plate 21), the DLC layer 40 that functions as a liquid repellent layer having liquid repellency property is layered. In the embodiment, the DLC layer 40 covers the entire nozzle surface 23. With reference to FIG. 3, the DLC layer 40 contains multiple columnar particles 41 arranged adjacent to one another. The columnar particles 41 are each made of, for example, microcrystalline diamond or DLC having a size from several tens of nanometers to several micrometers. These particles 41 are densely and randomly disposed on the nozzle surface 23. The particles 41 provide the surface of the DLC layer 40 with micro-irregularities. In detail, the particles 41 define protrusions 49 of the irregularities while gaps among the particles 41 define recesses 50 of the irregularities. The end of each particle 41 (protrusion 49), to be in contact with ink, tapers in a direction (in other words, the height direction) intersecting the one surface. That is, a recess 50 is defined between the slant surface of the tapered end of one protrusion 49 and the slant surfaces of the tapered ends of the adjoining protrusions 49. The recess 50 thus becomes wider toward the ends of the protrusions 49 in the height direction thereof. In addition, the particles 41 have various sizes. The ends of the adjoining protrusions 49 are thus located at mutually different positions in the height direction.

Providing such irregularities enables the nozzle surface 23 to have a lotus effect and thus liquid repellency property. That is, the nozzle surface 23 with such irregularities has liquid repellency property, based on the same principle as the surface of a lotus leaf that repels water. The tapered end of each protrusion 49 can reduce the contact area of the protrusion 49 in contact with ink (liquid). The ink (liquid) thus is in substantially point contact with each of the protrusions 49. This configuration can further improve the liquid repellency property of the nozzle surface 23. In addition, the ends of the adjoining protrusions 49 having mutually different heights have larger distances therebetween compared with adjoining protrusions having an equal height. That is, the contact points in contact with ink are more distant from one another. This configuration can further improve liquid repellency property. Furthermore, it is easy to fabricate the DLC layer 40 having liquid repellency property by containing multiple columnar particles 41 arranged adjacent to one another. A method of forming the DLC layer 40 on the nozzle surface 23 is described later in detail.

Figure 4:
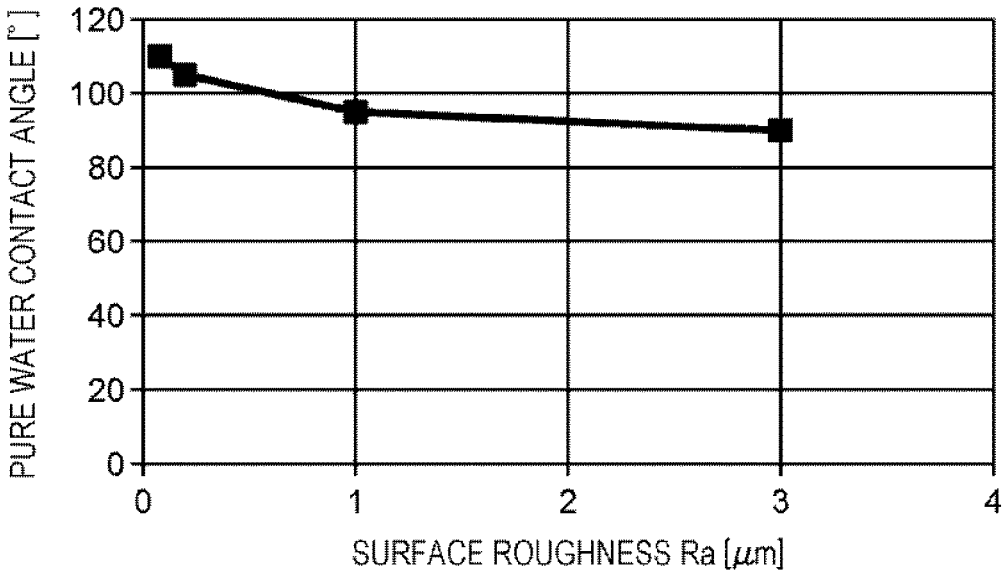
FIG. 4 is a graph illustrating the relationship between surface roughness and a contact angle.

The liquid repellency property (the level of liquid repellency property) varies in accordance with the surface irregularities, that is, the surface roughness of the DLC layer 40. FIG. 4 is a graph illustrating the relationship between the surface roughness (arithmetic average surface roughness Ra (μm)) and the contact angle (contact angle (°) with pure water) of the DLC layer 40. This graph demonstrates that as the surface roughness Ra decreases, the contact angle increases. In particular, a surface roughness Ra of 1 μm provides a contact angle of approximately 95°. In a typical printer, the nozzle surface 23 is required to have a contact angle of 90° or larger. Accordingly, the preferable surface roughness Ra of the DLC layer 40 is 1 μm or less. In the embodiment, the DLC layer 40 has a surface roughness Ra of approximately 0.08 μm (80 nm). The nozzle surface 23 according to the embodiment has thus a contact angle of approximately 110°. The thickness (film thickness) of the DLC layer 40 according to the embodiment is approximately 200 to 300 nm.

With reference to FIG. 2, the communication substrate 24 is made of silicon and constitutes the upper part of the channel unit 15 (the part adjacent to the head case 16). The communication substrate 24 is provided with the common liquid chamber 25 that is in communication with the liquid supply path 18 and stores ink to be shared by the pressure chambers 30, individual communication paths 26 each supplying the ink from the liquid supply path 18 via the common liquid chamber 25 to the pressure chamber 30, and nozzle communication paths 27 through which the pressure chamber 30 communicates with the nozzle 22. The liquid chamber and paths are formed by anisotropic etching on the communication substrate 24. Each of the common liquid chambers 25 is a space elongated in the nozzle array direction. Two rows of the common liquid chambers 25 corresponding to the two rows of the pressure chambers 30 are provided. The individual communication paths 26 and the nozzle communication paths 27 are disposed in the nozzle array direction.

With reference to FIG. 2, the actuator unit 14 according to the embodiment is a unit including the pressure chamber defining substrate 29, a diaphragm 31, piezoelectric elements 32 (a type of actuator), and a sealing plate 33 disposed on each other. The actuator unit 14 is joined to the communication substrate 24. The actuator unit 14 is smaller than the accommodating space 17 so as to be accommodated in the accommodating space 17.

The pressure chamber defining substrate 29 is a silicon substrate (for example, silicon single crystal substrate) and constitutes the lower part of the actuator unit 14 (the part adjacent to the channel unit 15). The pressure chamber defining substrate 29 has spaces that function as the pressure chambers 30 arranged in the nozzle array direction. These spaces are formed by anisotropic etching in the thickness direction in certain regions of the pressure chamber defining substrate 29. The bottoms of the spaces (pressure chambers 30) are defined by the communication substrate 24, whereas the tops are defined by the diaphragm 31. The spaces (pressure chambers 30) are arranged in two rows corresponding to the two nozzle arrays. Each of the pressure chambers 30 is a space elongated in the direction orthogonal to the nozzle array direction. The pressure chamber 30 has an end in the longitudinal direction thereof in communication with the individual communication path 26 and the other end in communication with the nozzle communication path 27.

The diaphragm 31 includes a flexible film made of silicon dioxide ($SiO_2$) formed on the upper surface of the pressure chamber defining substrate 29, and an insulating film made of zirconium oxide ($ZrO_2$) formed on the flexible film. The diaphragm 31 has drive regions 35 corresponding to the respective pressure chambers 30 and is allowed to be flexural and deformable in the drive regions 35. A piezoelectric element 32 is mounted in each drive region 35. The piezoelectric elements 32 according to the embodiment are of a flexural vibration mode. Each of the piezoelectric elements 32 is formed by layering, for example, a lower electrode layer, a piezoelectric layer, and an upper electrode layer in this sequence on the diaphragm 31. One of the upper and lower electrode layers is an electrode common to all the piezoelectric elements 32, whereas the other is an electrode individually formed to the piezoelectric elements 32. In response to application of an electric field between the lower electrode layer and the upper electrode layer corresponding to the potential difference between both electrodes, the piezoelectric element 32 exhibits flexural deformation in the direction toward or away from the nozzle 22. This deformation varies the capacity of the pressure chamber 30 and thus varies the pressure of ink in the pressure chamber 30. Such a pressure variation can be used to eject the ink in the pressure chamber 30 through the nozzle 22. The piezoelectric elements 32 according to the embodiment are arranged in two rows in the nozzle array direction corresponding to the two rows of the pressure chambers 30 arranged in the nozzle array direction.

With reference to FIG. 2, the sealing plate 33 is a substrate made of, for example, a silicon single crystal, metal, or synthetic resin and is joined to the upper surface of the pressure chamber defining substrate 29 (specifically, the upper surface of the diaphragm 31). The lower surface of the sealing plate 33 has hollow portions extending from the lower surface of the sealing plate 33 to the middle of the sealing plate 33 in the thickness direction. These hollow portions define piezoelectric element accommodating spaces 36. The piezoelectric element accommodating spaces 36 accommodate the respective rows of the piezoelectric elements 32. In the embodiment, two piezoelectric element accommodating spaces 36 corresponding to the two rows of the piezoelectric elements 32 are provided. Between two piezoelectric element accommodating spaces 36, the sealing plate 33 has an opening extending through the thickness of the sealing plate 33. Terminals of a circuit board inserted through the insertion opening 19 and the terminals of wires extending from the piezoelectric elements 32 are connected in the opening.

Figure 5:
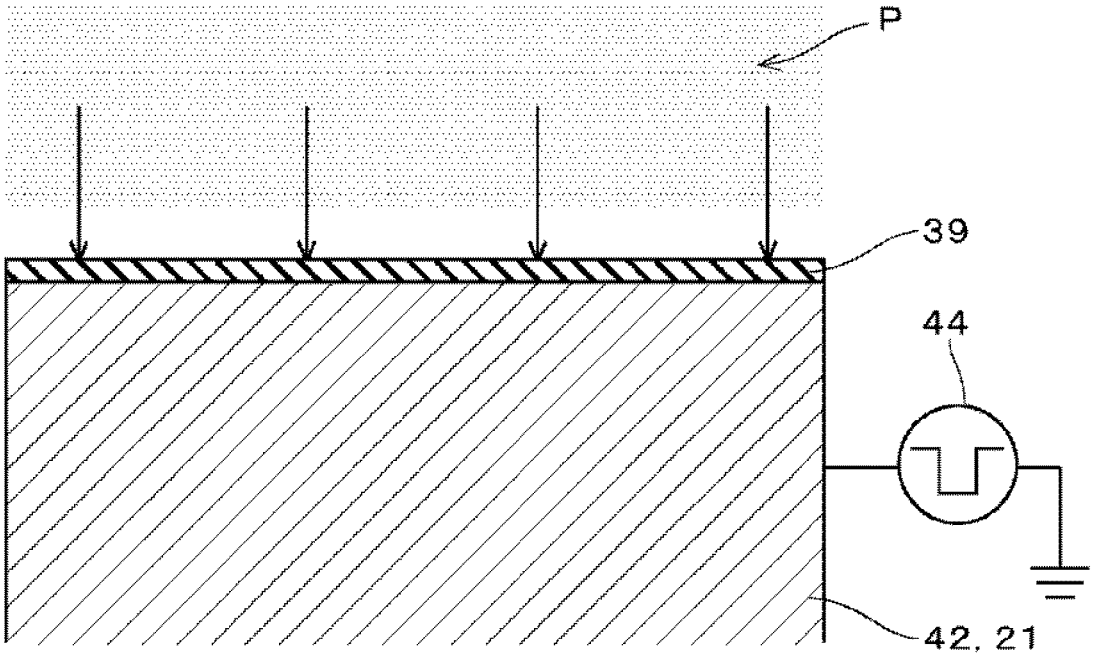
FIG. 5 is a schematic view describing a method of forming a diamond-like carbon (DLC) layer.

A method of fabricating the recording head 3 and, in particular, a method of fabricating the nozzle plate 21 is described in detail. An exemplary process involves forming the DLC layer 40 on a substrate 42 (such as a silicon wafer) to be the nozzle plate 21, and then dividing the substrate 42 into individual nozzle plates 21. FIG. 5 is a schematic sectional view of the nozzle plate 21 (substrate 42) describing the method of forming the DLC layer 40 (plasma ion implantation in the embodiment).

First, the substrate 42 to be the nozzle plate 21 is provided with nozzles 22 at predetermined positions. The nozzles 22 are formed, for example, by using a laser or by the Bosch process to extend through the thickness of the nozzle plate 21. Second, an underlying layer 39 is provided on the surface of the substrate 42. The underlying layer 39 is fabricated by, for example, forming a thermally oxidized film ($SiO_2$) on the surface of the nozzle plate 21 by thermal oxidation and then forming a layer, such as a tantalum oxide film (TaOx), by spattering, atomic layer deposition (ALD), chemical vapor deposition, or vacuum deposition.

After the fabrication of the underlying layer 39 on the nozzle plate 21, a DLC layer 40 is formed by plasma ion implantation as illustrated in FIG. 5. The plasma ion implantation involves generating gas plasma P in a plasma chamber by using a radio frequency (RF) power supply (not shown) and applying a high-voltage pulsed bias to the substrate 42 placed in the plasma chamber by using a pulsed power supply 44, for example, in cycles of several tens to several hundreds of microseconds, to accelerate ions in the plasma P. The substrate 42 is thus repeatedly irradiated with high-energy ions in a short period (refer to the arrows in FIG. 5). This process yields the DLC layer 40 on the substrate 42. In the embodiment, the gas pressure in the plasma chamber is adjusted to 1 Pa by introducing process gas including acetylene ($C_2H_2$) and methane ($CH_4$) into the plasma chamber at a flow rate of 40 sccm. The plasma is generated in the plasma chamber by applying radiofrequency power at a frequency of 13.56 MHz, for example, via a circuit installed in the plasma chamber. The pulsed bias applied from the pulsed power supply 44 to the substrate 42 has a negative peak bias voltage of −5 kV and a frequency of 4,000 Hz. In the embodiment, the plasma ion implantation is performed while the substrate 42 is heated with a heating mechanism (not shown), such as a heater.

A variation in the temperature of the substrate 42 in plasma ion implantation can provide layers having different configurations on the substrate 42. Specifically, a single amorphous layer is formed on the substrate 42 at a temperature of 200° C. or lower. In contrast, a DLC layer is formed on the substrate 42 at a temperature higher than 300° C. This DLC layer contains columnar particles 41 made of microcrystalline diamond or DLC and arranged adjacent to one another. That is, the surface of the DLC layer formed on the substrate 42 has micro-irregularities (protrusions 49 and recesses 50) derived from the columnar particles 41. As described above, the columnar crystals grow from the surface of the substrate 42 at a temperature higher than 300° C. to yield a DLC layer having surface irregularities. As the temperature of the substrate 42 rises above 300° C., the columnar particles 41 formed on the substrate 42 become smaller, thereby reducing the sizes of the surface irregularities. In other words, the higher the temperature of the substrate 42 in plasma ion implantation, the lower the surface roughness Ra of the DLC layer 40 formed on the substrate 42. In the embodiment, the DLC layer 40 is formed on the substrate 42 heated to 400° C. in plasma ion implantation. The DLC layer 40 thus formed has a surface roughness Ra of approximately 0.08 μm.

After the formation of the DLC layer 40 on the substrate 42 as described above, the substrate 42 is divided into individual nozzle plates 21, for example, with a cutter. Each of the resulting nozzle plates 21 has a nozzle surface 23 provided with the DLC layer 40. Then, the nozzle plate 21 after being divided is joined to the lower surface of the communication substrate 24, and the actuator unit 14 is joined to the upper surface of the communication substrate 24. The head case 16 is then mounted on the communication substrate 24 such that the actuator unit 14 is accommodated in the accommodating space 17. This process completes the recording head 3.

As described above, the plasma ion implantation can facilitate fabrication of the nozzle plate 21 provided with the DLC layer 40 having surface irregularities. The nozzle surface 23 of the nozzle plate 21 thus fabricated has liquid repellency property. In other words, the lotus effect can improve the liquid repellency property of the nozzle surface 23 of the nozzle plate 21. The DLC layer 40 (liquid repellent layer) that provides liquid repellency property to the nozzle plate 21 has high abrasion resistance (in other words, durability) and can thus suppress a reduction in the liquid repellency property of the nozzle surface 23 of the nozzle plate 21. This feature can increase the durability of the nozzle plate 21 against the wiping operation by the wiper 12, leading to an improvement in the reliability of the recording head 3 and the printer 1. In addition, an adjustment of the temperature of the substrate 42 in plasma ion implantation can vary the surface roughness of the DLC layer 40 and can thus adjust the level of liquid repellency property (specifically, the contact angle with ink) of the surface of the nozzle plate 21. In the embodiment, the DLC layer 40 has an arithmetic average surface roughness Ra of 1 μm or less. This configuration can further improve the liquid repellency property of the nozzle surface 23 of the nozzle plate 21.

Figure 6:
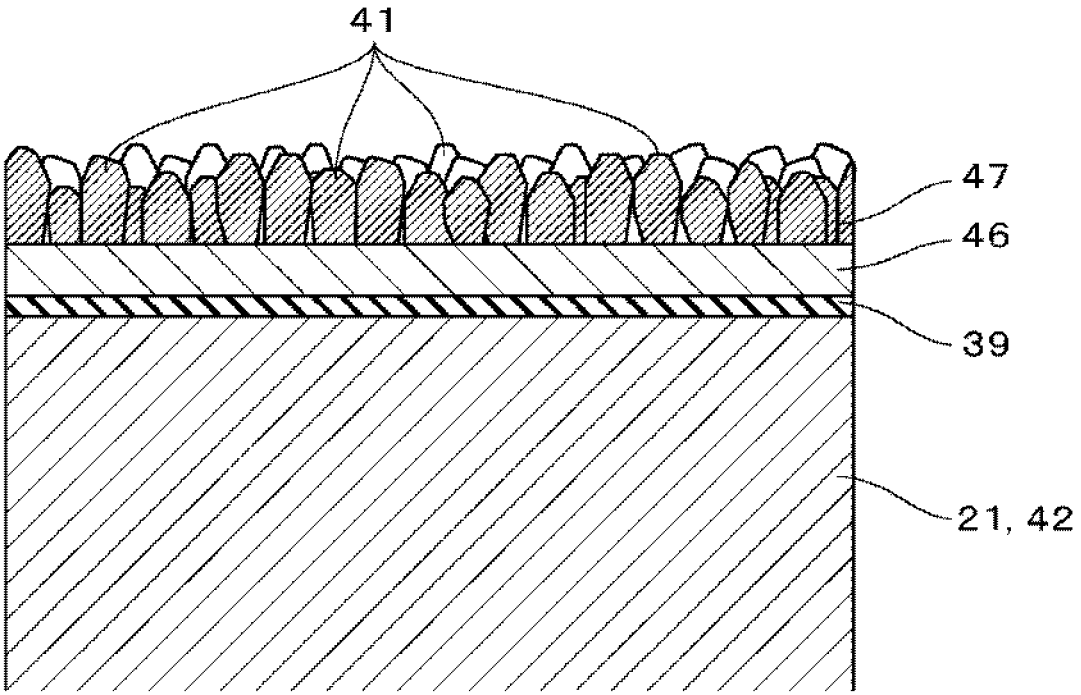
FIG. 6 is an enlarged schematic sectional view of a nozzle plate according to a second embodiment.

Although the DLC layer 40 is layered on the nozzle surface 23 of the nozzle plate 21 in the above-described first embodiment, this configuration should not be construed as limiting the invention. In the nozzle plate 21 according to a second embodiment illustrated in FIG. 6, the nozzle surface 23 is provided with an amorphous layer 46 thereon, and a DLC layer 47 is layered on the amorphous layer 46. Specifically, as in the first embodiment, the underlying layer 39 is formed on the surface of the nozzle plate 21. On the surface of the underlying layer 39 on the nozzle surface 23, the amorphous layer 46 and the DLC layer 47 are layered in the order mentioned. The amorphous layer 46 has substantially the same composition as the DLC layer 47 but is made of non-crystalline (amorphous) carbon different from DLC. The DLC layer 47 has an identical configuration to the DLC layer 40 according to the first embodiment and is not redundantly described. In the second embodiment, the amorphous layer 46 has a thickness (film thickness) of approximately 100 to 300 nm, while the DLC layer 47 has a thickness (film thickness) of approximately 200 to 300 nm. The amorphous layer 46 disposed between the nozzle surface 23 and the DLC layer 47 can function as a buffer film. In detail, the amorphous layer 46 is softer than the DLC layer 47 and can absorb, for example, a shock received from the outside. The DLC layer 47 having substantially the same composition as the amorphous layer 46 readily comes into tight contact with the amorphous layer 46. That is, the amorphous layer 46 can improve the adhesion of the DLC layer 47 to the nozzle plate 21. This configuration can suppress a reduction in the liquid repellency property caused by peeling and separation of a part of the DLC layer 47 (for example, the particles 41 constituting the DLC layer 47). Other configurations are identical to those of the first embodiment and are not redundantly described.

A method of fabricating this nozzle plate 21 is described. First, as in the first embodiment, the nozzles 22 and the underlying layer 39 are provided to the substrate 42 (nozzle plate 21). Then, the amorphous layer 46 is layered on the underlying layer 39. The amorphous layer 46 can be formed by adjusting the temperature of the substrate 42 in plasma ion implantation. Specifically, the film formation is performed by the plasma ion implantation while the substrate 42 is heated to 200° C., under the same conditions as for the formation of the DLC layer 40 in the first embodiment except for temperature. This process yields the amorphous layer 46 on the surface of the substrate 42. The DLC layer 47 is then formed by plasma ion implantation under the same conditions as for the formation of the DLC layer 40 in the first embodiment. This process yields the DLC layer 47 having a surface roughness Ra of approximately 0.08 μm on the amorphous layer 46. Alternatively, the amorphous layer 46 may be a graphene film, which is formed under different conditions in plasma ion implantation.

The DLC layer 40 or 47 in the above-described embodiments is not limited to a layer consisting of carbon and may also contain hydrogen or fluorine. In particular, including fluorine in the DLC layer 40 or 47 can further improve the liquid repellency property of the nozzle surface 23 of the nozzle plate 21. For example, a DLC layer 40 or 47 including a fluorine-containing diamond-like carbon (F-DLC) layer containing 0.5 to 30 atom % fluorine has higher liquid repellency property than a DLC layer containing no fluorine. Such a DLC layer 40 or 47 (that is, F-DLC layer) should also preferably have an arithmetic average surface roughness Ra of 1 μm or less. To produce such a DLC layer 40 or 47 containing fluorine, for example, gas containing fluorine components (fluorine atoms), such as tetrafluoromethane ($CF_4$) gas, is introduced into the plasma chamber in plasma ion implantation.

Although the nozzle plate 21 made of silicon is illustrated in the above-described embodiments, this configuration should not be construed as limiting the invention. For example, the nozzle plate 21 may also be made of a metal. In addition, a nozzle plate having ink resistance does not require an underlying layer thereon. In this case, a DLC layer or amorphous layer is layered directly on the surface of the nozzle plate. Although the piezoelectric elements for varying the pressure of ink in the pressure chambers 30 are of a flexural vibration mode in the above-described embodiments, this configuration should not be construed as limiting the invention. For example, the piezoelectric elements may be replaced with various actuators, such as piezoelectric elements of a vertical vibration mode, heater elements, and electrostatic actuators that vary the capacities of the pressure chambers by using electrostatic force.

Although the ink jet printer 1 equipped with the ink jet recording head 3 (a type of liquid ejecting head) is illustrated as the liquid ejecting apparatus in the above description, the invention can also be applied to various liquid ejecting apparatuses equipped with other types of liquid ejecting heads. Examples of such liquid ejecting apparatuses include liquid ejecting apparatuses equipped with a color-material ejecting head used for fabricating color filters of, for example, liquid crystal displays, liquid ejecting apparatuses equipped with an electrode material ejecting head for forming electrodes of, for example, organic electroluminescence (EL) displays and field emission displays (FEDs), and liquid ejecting apparatuses equipped with a bioorganic-material ejecting head for fabricating biochips. The color-material ejecting head for a display manufacturing apparatus ejects solutions of the respective color materials (types of liquid) of red (R), green (G), and blue (B). The electrode material ejecting head for an electrode forming apparatus ejects an electrode material in a liquid state (a type of liquid). The bioorganic-material ejecting head for a chip manufacturing apparatus ejects a solution of a bioorganic material (a type of liquid).

The entire disclosure of Japanese Patent Application No. 2017-121990, filed Jun. 22, 2017 is expressly incorporated by reference herein.

What is claimed is:

1. A nozzle plate comprising:

a base, a diamond-like carbon layer on the base, a nozzle open to one surface of the base; and wherein the diamond-like carbon layer is disposed adjacent to the one surface and the diamond-like layer has a surface with recesses and protrusions, tips of the protrusions adjoining one another being located at different positions in a height direction intersecting the one surface.

2. The nozzle plate according to claim 1, wherein the recesses and protrusions of the diamond-like carbon layer are provided by particles having various sizes.

3. A liquid ejecting head comprising the nozzle plate according to claim 2, comprising:

a communication substrate having a channel and joined the nozzle plate.

4. The nozzle plate according to claim 1, wherein the diamond-like carbon layer contains fluorine.

5. A liquid ejecting head comprising the nozzle plate according to claim 4, comprising:

a communication substrate having a channel and joined the nozzle plate.

6. The nozzle plate according to claim 1, wherein the diamond-like carbon layer has an arithmetic average surface roughness Ra equal to or higher than 0.08 μm and equal to or lower than 1 μm.

7. A liquid ejecting head comprising the nozzle plate according to claim 6, comprising:

a communication substrate having a channel and joined the nozzle plate.

8. The nozzle plate according to claim 1, further comprising:

an amorphous layer layered on the diamond-like carbon layer.

9. A liquid ejecting head comprising the nozzle plate according to claim 8, comprising:

a communication substrate having a channel and joined the nozzle plate.

10. A liquid ejecting head comprising the nozzle plate according to claim 1, comprising:

a communication substrate having a channel and joined the nozzle plate.

* * * * *